US006380943B1

(12) United States Patent
Morita et al.

(10) Patent No.: US 6,380,943 B1
(45) Date of Patent: Apr. 30, 2002

(54) COLOR DISPLAY APPARATUS

(75) Inventors: Tomoko Morita, Hirakata; Yuichi Ishikawa, Ibaraki; Mitsuhiro Kasahara, Hirakata, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/530,942

(22) PCT Filed: Sep. 14, 1999

(86) PCT No.: PCT/JP99/05006

§ 371 Date: May 10, 2000

§ 102(e) Date: May 10, 2000

(87) PCT Pub. No.: WO00/17845

PCT Pub. Date: Mar. 30, 2000

(30) Foreign Application Priority Data

Sep. 18, 1998 (JP) ..... 10-264616
May 6, 1999 (JP) ..... 11-125817

(51) Int. Cl.[7] ..... G09G 3/28

(52) U.S. Cl. ..... 345/589; 345/591; 345/600; 345/604

(58) Field of Search ..... 345/589, 591, 345/600, 604

(56) References Cited

U.S. PATENT DOCUMENTS 5,257,096 A 10/1993 Oshima
5,303,071 A 4/1994 Kakimura
5,652,831 A * 7/1997 Huang et al. ..... 395/131
5,745,085 A 4/1998 Tomio et al.
5,758,410 A * 6/1998 Ohta et al. ..... 382/162
6,025,823 A * 2/2000 Choi ..... 345/101

FOREIGN PATENT DOCUMENTS

JP 8-65607 3/1996

OTHER PUBLICATIONS

English Language Abstract of Japanese Patent Laid–open Publication No. 8–65607.

* cited by examiner

*Primary Examiner*—Richard Hjerpe
*Assistant Examiner*—Jean Lesperance
(74) *Attorney, Agent, or Firm*—Greenblum & Bernstein P.L.C.

(57) ABSTRACT

This invention provides a display apparatus having high accuracy to control automatically power consumed for display operation suitable for emission-type display apparatus like a plasma display apparatus, electroluminescence display apparatus and a light emission diode display apparatus. The display apparatus comprises an emission unit (27), integrating circuits (11,12,13) for integrating input picture signals of R, G and B for each predetermined period to output average levels of R signal, G signal and B signal, respectively, multiplying circuits (14,15,16) for multiplying those average levels by their respective parameters KR, KG and KB, respectively, an adder (17) for obtaining a signal indicating expected consumption power on the emission unit by adding output signals from the multiplying circuits, a controller (18) for receiving the power prediction signal to output a control signal based on the received signal, and a brightness control circuit for controlling light emission amount per unit area according to the control signal.

6 Claims, 11 Drawing Sheets

Fig.2

NUMBER OF EMISSION PULSES

| EMISSION PULSE CONTROL SIGNAL | SF1 | SF2 | SF3 | SF4 | SF5 | SF6 | SF7 | SF8 | TOTAL |
|---|---|---|---|---|---|---|---|---|---|
| EMISSION TYPE A | 5 | 10 | 20 | 40 | 80 | 160 | 320 | 640 | 1275 |
| EMISSION TYPE B | 4 | 8 | 16 | 32 | 64 | 128 | 256 | 512 | 1020 |
| EMISSION TYPE C | 3 | 6 | 12 | 24 | 48 | 96 | 192 | 384 | 765 |
| EMISSION TYPE D | 2 | 4 | 8 | 16 | 32 | 64 | 128 | 256 | 510 |
| EMISSION TYPE E | 1 | 2 | 4 | 8 | 16 | 32 | 64 | 128 | 255 |

COLOR DISPLAY APPARATUS

TECHNICAL FIELD

The present invention relates to display apparatuses such as plasma displays, electroluminescence displays, and light emitting diode displays.

BACKGROUND ART

Conventionally, a light-emitting type display apparatus such as a plasma display, an electroluminescence display or a light emitting diode display generally emits light to display when it has some amount of information that should be displayed. The display apparatus inevitably involves large power consumption as the amount of information to be displayed becomes large. Therefore, it has been studied to restrict power consumption when the amount of display data has become large. In Japanese Patent Laid-Open Publication No. H08-65607, it is disclosed that depending on average luminance signal level of images, an automatic power control (APC) section adjusts the light emission amount per unit area (luminance) of a display in response to variations in the average luminance signal level so that the power consumption is controlled so as not to increase excessively.

FIG. 11 is a block diagram showing the configuration of the display apparatus according to the prior art disclosed in the publication. R, G and B signals as picture signals are fed into their corresponding terminals. The R, G and B signals via their corresponding terminals are fed into a Y-encode circuit 61 which encodes the R, G and B signals into a luminance signal (hereinafter, referred to as Y signal) to output. A digital luminance integrating circuit 62 inputs and integrates the Y signal from the Y-encode circuit 61 to output an average luminance.

Taking as a parameter the average luminance outputted from the digital luminance integrating circuit 62, a memory controller 63 receives data corresponding to the average luminance from a memory 64 to output the data to an automatic power controller 66 of a plasma display apparatus 68. The automatic power controller 66 outputs to a PDP (plasma display panel) display section 67 a control signal for adjusting the light emission amount per unit area (luminance) of the PDP display section 67 in response to the data from the memory control section 63, thereby power consumption is controlled.

However, the power consumption at the PDP display section 67 is not proportional to the luminance signal. For example, with a common transform equation, Y=0.3R+0.59G+0.11B, used in the Y-encode circuit 61, the ratio among their respective luminance signals (YR, a luminance signal for display of single red; YG, a luminance signal for display of single green; and YB, a luminance signal for display of single blue) is YR: YG: YB =0.3:0.59:0.11 when single color of red (hereinafter, expressed as R), green (hereinafter, expressed as G) and blue (hereinafter, expressed as B) are displayed,. Here, the luminance signal YG for the display of G is the largest and the luminance signal YB for the display of B is the smallest so that different control processes are performed by the automatic power controller 66 for the respective cases of the display of the single color depending on the average luminance. Ratio among respective coefficients (0.3, 0.59,0.11) for obtaining luminance signals in the transform equation equals to a ratio at which human eyes feel the brightness with each three primary colors (R, G, B), and do not show any power consumption ratio. Therefore, it may cause inappropriate control to be performed.

As shown above, in the technique of the prior art, with average luminance used as a parameter for the power consumption control of a display apparatus, light emission amount (luminance) of the display section 67 would be recognized as less than required amount in the case of an image in which green components occupy a larger portion than the other colors, and power consumption would be recognized as more than the performance of the power supply 65 in the case of an image in which blue components occupy a larger portion than the other colors. Thus, it has been a problem of the prior art technique that an accurate automatic control of power consumption or light emission amount cannot be achieved.

DISCLOSURE OF THE INVENTION

In order to solve the above problem, a display apparatus of the present invention is characterized in that the light emission amount (luminance) or power consumption is controlled based on a power prediction signal obtained by weighted average levels of individual colors with coefficients representing ratios of power consumptions involved in data display when the three primary colors of red, green and blue are displayed in single colors, respectively, or representing ratios of phosphor areas of the individual colors, and by then summing up the weighted average levels.

According to the present invention, since the power consumption or light emission amount (luminance) is controlled based on a power prediction signal computed with coefficients representing power consumption ratios or phosphor area ratios, it becomes possible to control the power consumption or light emission amount (luminance) independently of the hue of input picture signals.

In a first aspect of the invention, a display apparatus comprises an emission unit, integrating circuits, three multiplying circuits, a power consumption prediction circuit, a controller and a brightness control circuit.

The emission unit emits light to display images. The integrating circuits integrate input picture signals of R (red), G (green) and B (blue) for each predetermined period to output an average level of R signal, an average level of G signal and an average level of B signal, respectively. The first, second and third multiplying circuits multiplies the R average level, the G average level and the B average level by their respective parameters KR, KG and KB, respectively. The power prediction circuit adds output signals from those multiplying circuits together to obtain and output a power prediction signal. The signal indicates amount of power predicted or expected to be consumed on the emission unit. The controller receives the power prediction signal to output a control signal based on a value of the received signal. The brightness control circuit controls light emission amount per unit area according to the control signal.

In the display apparatus, a ratio of parameters KR, KG and KB may be determined to be equal to a ratio of powers consumed for display each color of red, green and blue with same brightness. In this case, the display apparatus can control the power consumption or light emission amount (luminance) more accurately, as compared with the prior art technique in which power consumption of the display apparatus is controlled with average luminance.

In a second aspect of the invention, a display apparatus comprises an emission unit, integrating circuits, first, second and third multiplying circuits, a power consumption prediction circuit, a controller, a delay circuit and a first, second and third multiplying circuits.

The emission unit emits light to display images. The integrating circuits integrates input picture signals of R, G and B for each predetermined period to output an average level of R signal, an average level of G signal and an average level of B signal, respectively. The first, second and third multiplying circuits multiplies the R average level, the G average level and the B average level by their respective parameters KR, KG and KB, respectively. The ratio of parameters KR, KG and KB is determined to be equal to a ratio of powers consumed for display each color of red, green and blue with same brightness. The power consumption prediction circuit adds output signals from the multiplying circuits together to obtain and output a power prediction signal. The signal indicates amount of power expected to be consumed on the emission unit. The controller receives the power prediction signal to output a multiplying coefficient based on a value of the received signal. The delay circuit delays the input picture signals of R, G and B to output the delayed picture signals DR, DG and DB, respectively. The fourth, fifth and sixth multiplying circuits multiplies the delayed picture signals DR, DG and DB by the multiplying coefficient, respectively.

In a third aspect of the invention, a display apparatus for dividing one field of picture signal into a plurality of subfields weighted respectively, and then displaying images of subfields in superimposition on time region to realize gradation expression.

The display apparatus comprises an emission unit, R, G and B integrating circuits, multiplying circuits, a power consumption prediction circuit, a controller, a delay circuit, picture signal-subfield associating circuit, a subfield pulse generator.

The emission unit emits light to display images. The R integrating circuit, G integrating circuit and B integrating circuit integrates at least one field of input picture signals of R, G and B to output an average level of R signal, an average level of G signal and an average level of B signal, respectively. The multiplying circuits multiplies the R average level signal, the G average level signal and the B average level signal by parameters KR, KG and KB determined based on the ratio of powers consumed for display each color of red, green and blue. The power consumption prediction circuit adds output signals from the first, second and third multiplying circuits together to obtain and output a power prediction signal. The signal indicates power expected to be consumed on the emission unit. The controller receives the power prediction signal to output a emission pulse control signal for selecting one of light emission types in response to a value of the received signal. The delay circuit for delaying the input picture signals R, G and B to output the delayed picture signals DR, DG and DB, respectively. The picture signal-subfield associating circuit receives the emission pulse control signal and the delayed picture signals DR, DG and DB, and associates output signals from the delay circuit with subfield structure of the light emission type based on the emission pulse control signal. The subfield pulse generator receives the emission pulse control signal, and generates pulses in the subfield structure corresponding to the light emission type based on the emission pulse control signal. The pulses include at least one of scanning pulses, sustaining pulses and erasing pulses.

In a forth aspect of the invention, a display apparatus for displaying images of subfields in superimposition on time region to display data with gradation, by dividing one field of picture signal into a plurality of subfields weighted.

The display apparatus comprises an emission unit, R, G and B integrating circuits, first, second and third multiplying circuits, a power consumption prediction circuit, a controller, a delay circuit, forth, fifth and sixth multiplying circuits, a picture signal-subfield associating circuit, a subfield pulse generator.

The emission unit emits light to display images. The R integrating circuit, G integrating circuit and B integrating circuit integrates at least one field of input picture signals of R, G and B to output an R average level signal, a G average level signal and a B average level signal, respectively. The multiplying circuits multiplies the R average level signal, the G average level signal and the B average level signal by respective parameters KR, KG and KB obtained by a ratio of powers consumed for display each color of red, green or blue. The power consumption prediction circuit adds output signals from the multiplying circuits together to obtain and output a power prediction signal. The signal indicates power expected to be consumed on the emission unit. The controller receives the power prediction signal to output a emission pulse control signal and a multiplying coefficient according to a value of the received signal. The emission pulse control signal is available for selecting one of light emission types, the multiplying coefficient is available for equalizing gray scale level at a border of adjacent emission types. The multiplying coefficient is obtained based on the power prediction signal from the controller. The delay circuit delays the input picture signals of R, G and B to output delayed picture signals DR, DG and DB, respectively. The fourth, fifth and sixth multiplying circuits multiplies the delayed picture signals DR, DG and DB by a multiplying coefficient for collecting gray scale level so as to equalize gray scale level between adjacent emission types at changeover point of those emission types, respectively. The picture signal-subfield associating circuit receives the emission pulse control signal and the signals of the fourth, fifth and sixth multiplying circuits as inputs, and associates the received signals from the fourth, fifth and sixth multiplying circuits with subfield structure of a light emission type responsive to the emission pulse control signal. The subfield pulse generator receives the emission pulse control signal, and generates pulses including scanning, sustaining, erasing pulses with the subfield structure of a light emission type responsive to the emission pulse control signal.

In the display apparatus described above, a ratio of the parameters KR, KG and KB may be equal to a ratio of area of phosphors for each color of red, green and blue. Since the areas of the phosphors are generally proportional to the power consumption, the power prediction signal can be estimated in a simplified manner by weighting the individual color average levels with coefficients representing the area ratios of the phosphors and then summing up the weighted average levels.

BRIEF DESCRIPTION OF THE DRAWINGS

FIG. 2 is a view showing light emission types of the display apparatus.

BEST MODE FOR CARRYING OUT THE INVENTION

Referring to accompanied drawings, preferred embodiments of the present invention are described.

(Embodiment 1)

Figure 1:
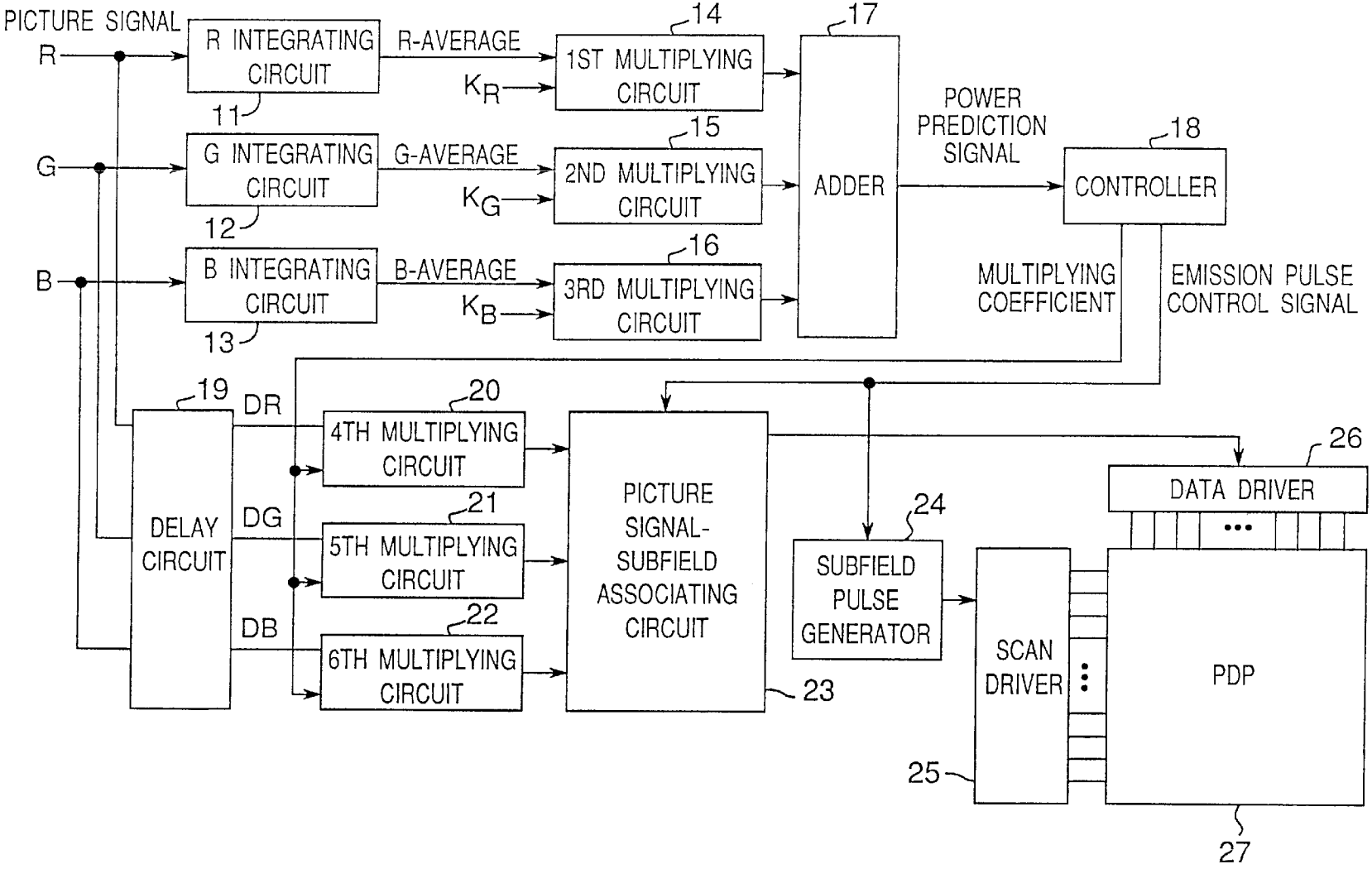
FIG. 1 is a block diagram showing the configuration of a display apparatus of a preferred embodiment of the present invention.

FIG. 1 is a block diagram showing an embodiment of the display apparatus according to the present invention. The display apparatus includes R G and B integrating circuits. 11, 12 and 13, first, second and third multiplying circuits 14, 15 and 16, an adder 17, a controller 18, a delay circuit 19, fourth, fifth and sixth multiplying circuits 20, 21 and 22, a picture signal-subfield associating circuit 23, a subfield pulse generator 24, a scan driver 25, a data driver 26 and a PDP (Plasma Display Panel) 27.

The R integrating circuit 11, the G integrating circuit 12 and the B integrating circuit 13 receive an R signal, a G signal and a B signal as their input picture signals, respectively, and produce output values as an R average level, a G average level and a B average level resulting from integrating those signals of a specific period, for example at least one field, and then dividing integration results by the number of integration pixels.

R average level, G average level and B average level, are inputted to a first multiplying circuit 14, a second multiplying circuit 15 and a third multiplying circuit 16, respectively, where the average levels are multiplied by individual coefficients, KR, KG and KB, respectively, and the results are outputted to the adder 17. The coefficients KR, KG and KB are defined such that ratio of those coefficients is equal to ratio of consumed power among R, G and B colors required for displaying data with a single color respectively. That is, picture signals with same conditions are inputted for R, G and B signal, respectively, without operation of the controller 18, and consumed power required for displaying data in the PDP 27 with respective color is measured. Then, the ratio of coefficients KR, KG and KB are set to the ratio of those measured powers for each color.

For example, the coefficients KR, KG and KB may be determined to have a ratio such as KR:KG:KB=PR:PG:PB, where PR is consumed power required for displaying an image with a single color of red, PG is consumed power required for displaying the image with a single color of green, PB is consumed power required for displaying the image with a single color of blue in the PDP 27.

The first multiplying circuit 14 multiplies the R average level by the coefficient KR, the second multiplying circuit 15 multiplies the G average level by the coefficient KG, and the third multiplying circuit 16 multiplies the B average level by the coefficient KB. The adder 17 adds up output signals from the first multiplying circuit 14, the second multiplying circuit 15 and the third multiplying circuit 16 to obtain and output a power prediction signal which indicates amount of power expected to be consumed on the PDP 27. The controller 18 inputs the power prediction signal, selects one of light emission types to adjust the light emission amount per unit area (luminance) of the display apparatus so as to limit power consumption, and outputs emission pulse control signal corresponding to the selected light emission type. Simultaneously, the controller 18 also outputs a multiplying coefficient by which the light emission amount (luminance) of an image does not differ at bounds of light emission types. The operation of the controller 18 is described in detail below.

The delay circuit 19 inputs the input picture signals R, G and B, produces picture signals DR, DG and DB which are delayed by a total time required at the individual sections of the integrating circuits 11, 12 and 13, the multiplying circuits 14 to 16, the adder 17 and the controller 18 to output. The forth, fifth and sixth multiplying circuits 20, 21 and 22 input the delayed picture signals DR, DG and DB, respectively, and multiply the delayed picture signals DR, DG and DB by the multiplying coefficient from the controller 18 to output.

The picture signal-subfield associating circuit 23 inputs signals from the fourth, fifth and sixth multiplying circuits 20, 21 and 22 as well as the emission pulse control signal. The picture signal-subfield associating circuit 23 converts the signals from the fourth, fifth and sixth multiplying circuits 20, 21 and 22 expressed in powers of 2 into light-emission patterns of subfields of the light emission type corresponding to the emission pulse control signal and then transmits data of the first subfield, data of the second subfield, and the data of the n-th subfield of each pixel in sequence during a one-field period at specified timing (where n is the number of subfields). It is noted that several operations, such as operation for changing the number of subfields to suppress the pseudo-contour noise, may be performed in the picture signal-subfield associating circuit 23.

The subfield pulse generator 24 inputs the emission pulse control signal, and supplies a scanning sustaining and erasing signals with subfield structure of the light emission type corresponding to the emission pulse control signal to the scan driver 25. The scan driver 25 supplies scanning, sustaining and erasing signals to row electrodes of a PDP 27 at specified voltage level.

The data driver 26 inputs the output signal of the picture signal-subfield associating circuit 23, generates image data pulses, each of which has voltage corresponding to individual pixel data, and divides these pulses by columns to supply them to column electrodes of PDP 27 in synchronism with signals outputted from the scan driver 25. Thus PDP 27 is driven to display images according to the input picture signals.

In this preferred embodiment, when consumed power to display increases according to increase of amount of information to be displayed by change of input picture signal, light emission amount and brightness in the apparatus are controlled to limit consumed power within predetermined range. Specifically, light emission type (emission period and number of emission) and gradation of the brightness in the display apparatus is controlled such that consumed power to display does not become larger than a predetermined value P. For this purpose, the display apparatus expects the consumed power based on the input picture signals, and then controls the emission type (emission period and number of times of emission) and gradation (or gray scale) based on the expected consumed power such that the consumed power is limited to be in a predetermined range.

In more detail, the controller 18 selects a light emission type in response to the power prediction signal and outputs an emission pulse control signal for controlling the light emission type (emission time duration or number of times of emission), as well as multiplying coefficients for adjustment of the gray scale level (or gradation level) of an input picture signal so that the light emission amount or luminance transits smoothly in the display apparatus between adjacent light emission types.

The determination of the light emission type and the multiplying coefficients in the controller 18 is described below.

The emission type is firstly explained. As shown in FIG. 2, the display apparatus of this embodiment has five emission types including emission type A, emission type B, emission type C, emission type D and emission type E, which decrease in the total number of times of light emission as 1275, 1020, 765, 510 and 255, respectively, as the power prediction signal increases in value.

On the basis of 8-bit gray scale levels ranging from 0 to 25.5, the number of emission pulses is so set that the number of times of light emission is fivefold larger than the gray scale levels in the emission type A, fourfold larger than the gray scale levels in the emission type B, and likewise threefold, twofold and one-fold larger than the gray scale levels in the emission type C, emission type D and emission type E, respectively.

Figure 3:
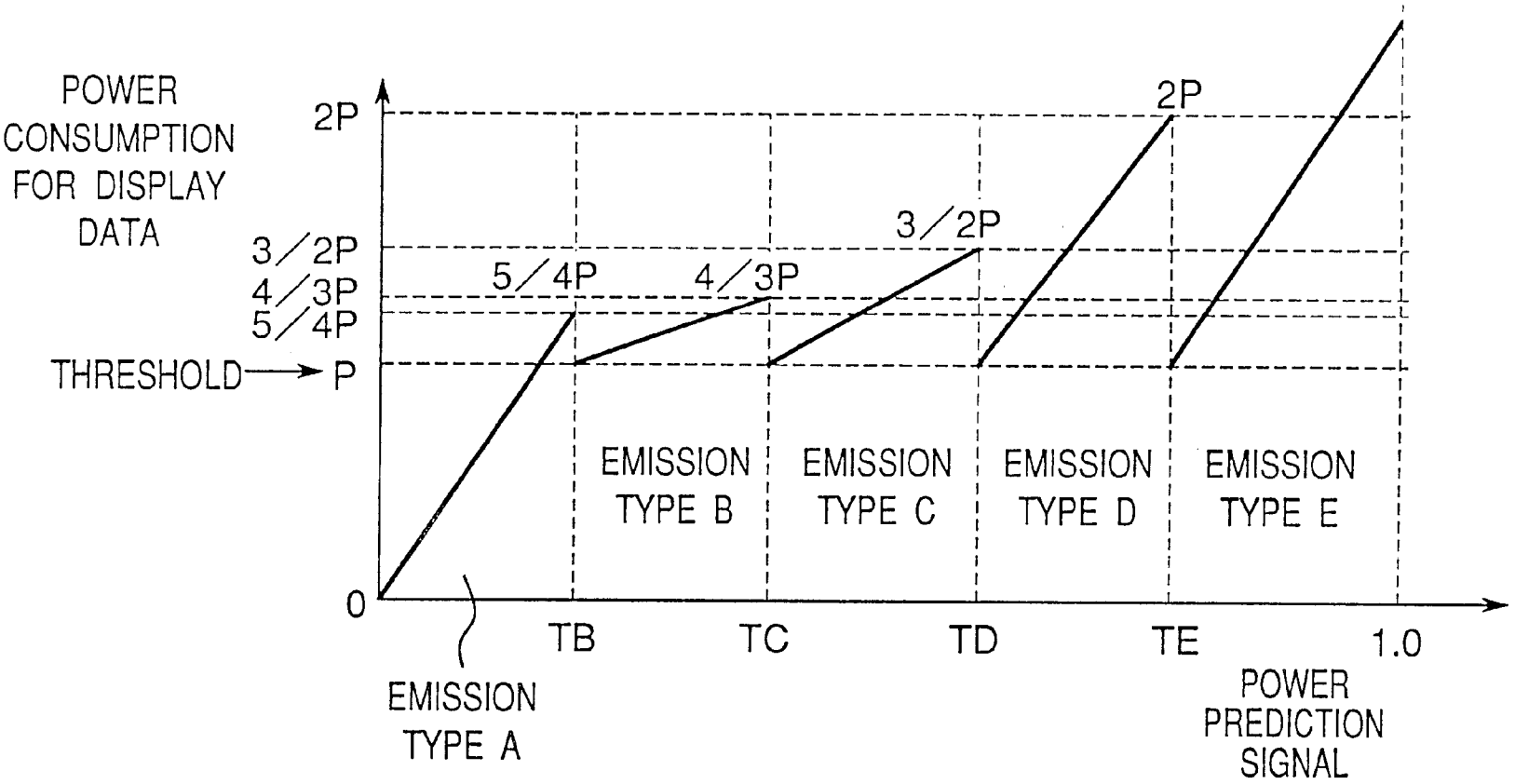
FIG. 3 is a view showing a relation between the power prediction signal and the actual consumption power when gradation correction is not performed by the multiplying coefficient.

These emission types are changed over based on the power prediction signal. The value (changeover point) of the power prediction signal which causes changeover of the emission type is described below. FIG. 3 explains the determination of changeover points of the light emission type. The figure shows the relation between the power prediction signal and the consumed power for display. As shown in this figure, the emission type A and the emission type B are changed over .at the predetermined value TB. The emission type B and the emission type C are changed over at the predetermined value TC. The emission type C and the emission type D are changed over at the predetermined value TD. The emission type D and the emission type E are changed over at the predetermined value TE. The value TE, for example, is obtained as follows. The consumed power is measured according to the vary of the input picture signal which varies to reduce the power prediction signal gradually from the maximum value of the signal. It is noted that the power prediction signal is obtained under the condition that the multiplying coefficient is 1. The consumed power decreases according to the decrease of the power prediction signal. The changeover point TE is determined at the point where the consumed power is equal to the predetermined value P.

The consumed power becomes 2P for the light emission with the power prediction signal which is TE and the emission type which is D, because the number of times of emission type D is two times of that of emission type E. While the power prediction signal is decreased gradually from this point TE as a start point, the value at which the consumed power reaches P is obtained as the power prediction signal value TD. The exchange points TC and TB are determined respectively in like manner.

Figure 4:
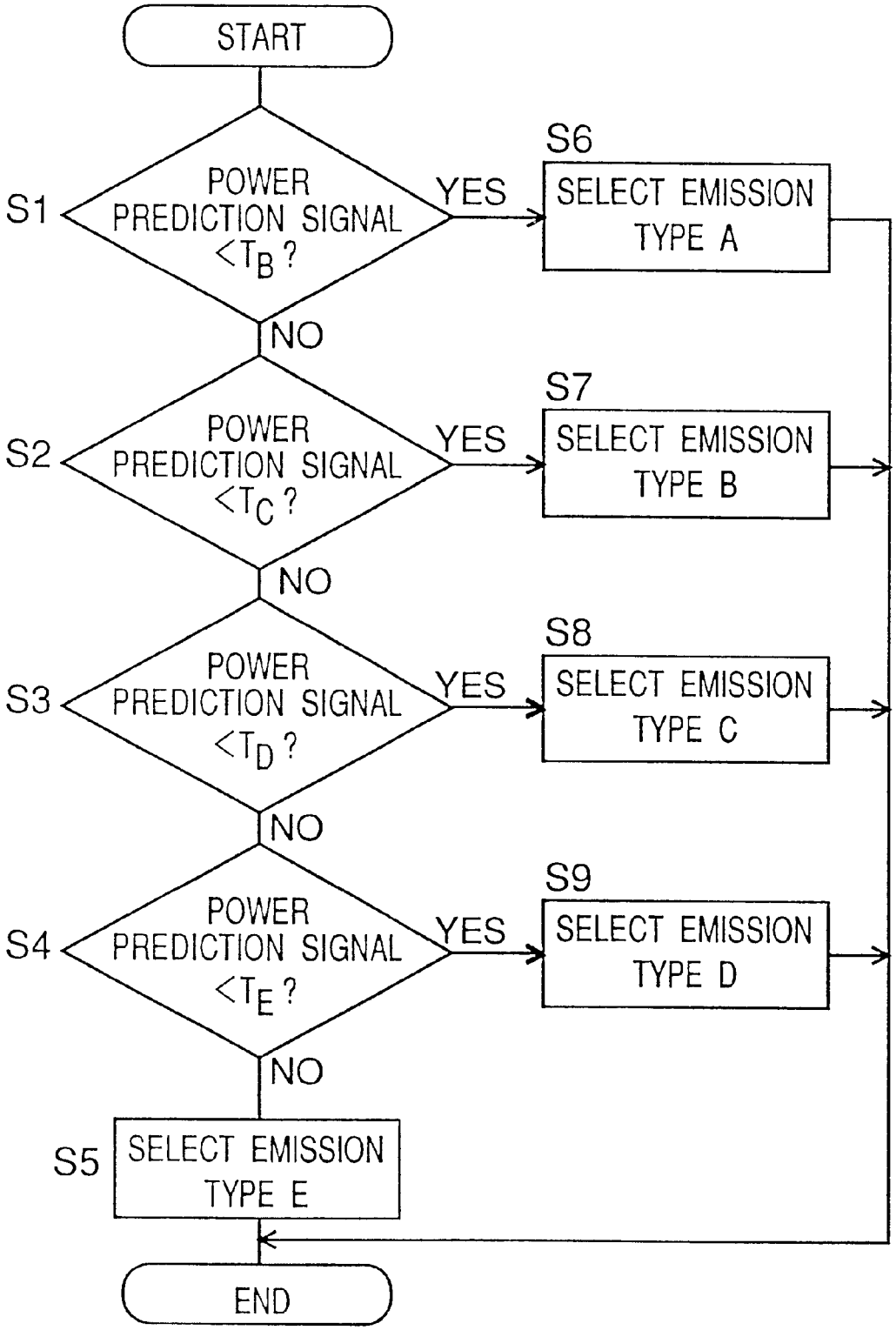
FIG. 4 is a view explaining operation for selection of light emission type by the controller.

FIG. 4 is a flowchart of showing the operation of the controller 18 which determines the emission type based on the power prediction signal. As shown in FIG. 4, firstly, the power prediction signal is compared to the predetermined value TB (S1). When the signal is smaller than the value TB, the emission type A is selected (S6). When the signal is not smaller than the value TB, the signal is compared to the predetermined value TC (S2). When the signal is smaller than the value TC, the emission type B is selected (S7). When the signal is not smaller than the value TC, the signal is compared to the predetermined value TD (S3). When the signal is smaller than the value TD, the emission type C is selected (S8). When the signal is not smaller than the value TD, the signal is compared to the predetermined value TE (S4). When the signal is smaller than the value TE, the emission type D is selected (S9). When the signal is not smaller than the value TE, the emission type E is selected (S5).

When only changeovers among emission types having different numbers of times of light emission are performed on signals of the same gray scale level, the difference in number of times of light emission is detected as a luminance difference in the display apparatus at a changeover of emission type. Thus it needs to adjust the gray scale level of an input picture signal. Furthermore, as shown in FIG. 3, the consumed power for displaying data is greatly over the value P. Therefore, the controller 18 outputs the multiplying coefficients varying in response to the power prediction signal, and then the gray scale level to be actually displayed is corrected by multiplying the input picture signals by the multiplying coefficients.

For example, when the power prediction signal is changed so that the emission type is changed over from emission type A to B, the following relation for same gray scale level is obtained as follows;

(luminance in emission type A): (luminance in emission type B)=(number of times of emission in emission type A) (number of times of emission in emission type B)=5:4.

Therefore, the multiplying coefficient in the emission type A is so set as to be 1 for a small value of the power prediction signal. It is also so set as to monotonously decrease with increasing the power prediction signal, and be 4/5=0.8 at a region adjacent to the region of the emission type B. For example, when the gray scale level of the input picture signal is 200, at the border between type A and type B, the gray scale level by the emission type A adjacent to the region of the emission type B is (200×0.8), which results in a number of times of light emission, (200×0.8)×5=800, while the number of times of light emission in the emission type B adjacent to the emission type A is 200×4=800. Thus, the luminance in a display section 22 can be made equal between the two emission types.

As to the changes in the other emission types as well, with the same concept, the multiplying coefficients are so set as to be from 1 to 0.75 (¾) in the emission type B, 1 to 0.67 (⅔) in the emission type C, and the like as the power prediction signal increases in value. By determining the multiplying coefficients like this, it is possible to control gray scale level in display apparatus to allow luminance difference not to be detected even though the emission type is changed over.

For example, when TB=0.2, TC=0.4, TD=0.6 and TE=0.8, the power prediction signal value x and the multiplying coefficient y are obtained as follows;

$$\text{emission type A: } y=-x+1(x<0.2) \quad (1)$$

$$\text{emission type B: } y=-5/4x+5/4(0.2<=x<0.2) \quad (2)$$

$$\text{emission type C: } y=-5/3x+5/3(0.4<=x<0.6) \quad (3)$$

emission type D: $y=-5/2x+5/2(0.6<=x<0.8)$ (4)

emission type E: $y=ax+(1-0.8a)(0.8<=x)$ (5).

When x>=0.8, that is, emission type is E, the multiplying coefficient y is 1.0 with x=0.8. The constant "a" is set not to be larger than zero so that the multiplying coefficient y decreases as the power prediction signal x increases, and to be any value which limits the consumed power to the predetermined value P. For example, when x=0. 15 and the emission type A is selected, the multiplying coefficient is calculated as follows;

$$Y=-x+1=-0.15+1=0.85.$$

Figure 5:
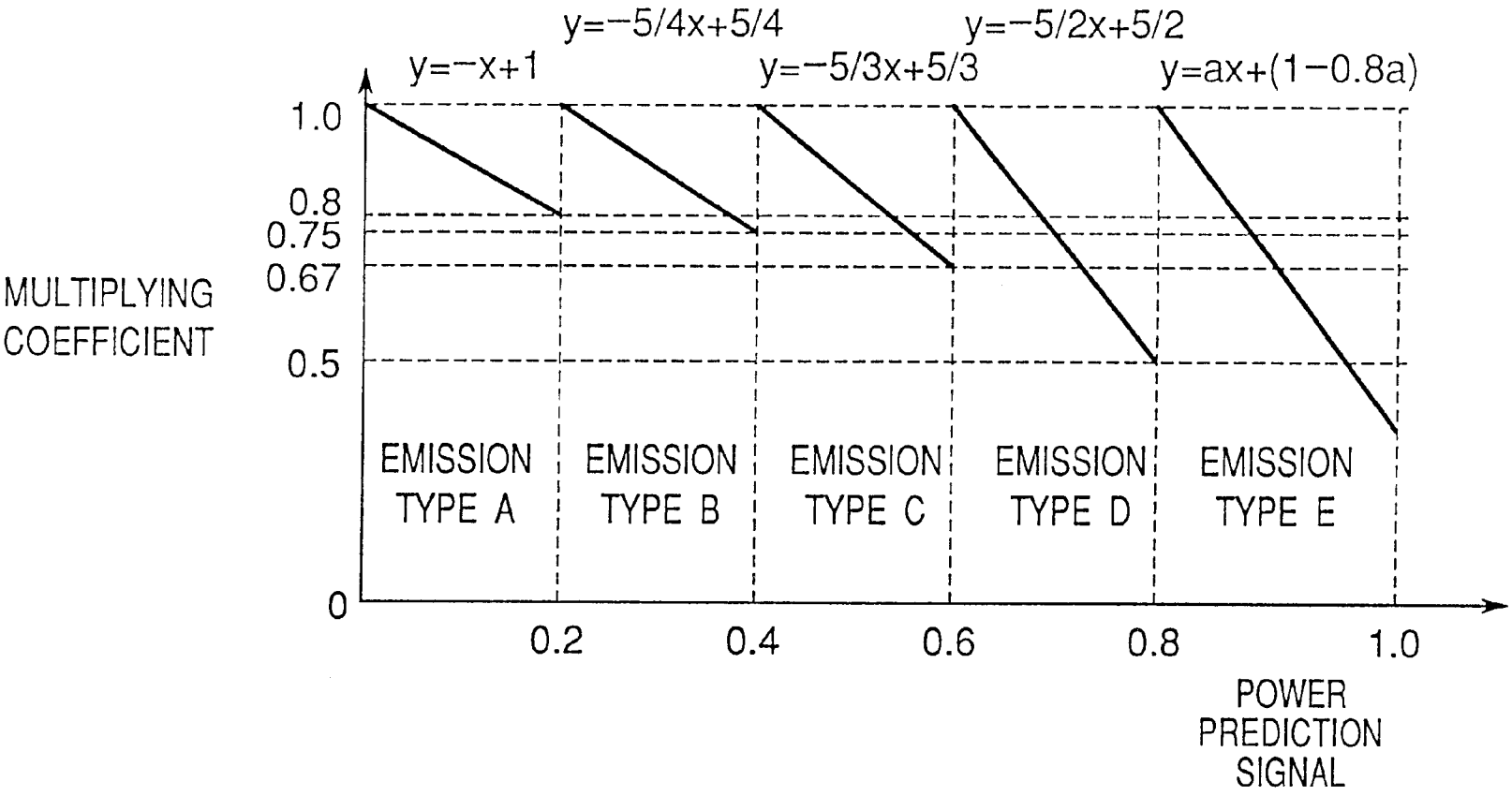
FIG. 5 is a view showing a relation between the power prediction signal and the multiplying coefficient in the display apparatus.

FIG. 5 shows the change of the multiplying coefficient to the power prediction signal by calculating the multiplying coefficient in a manner as described above.

Figure 6:
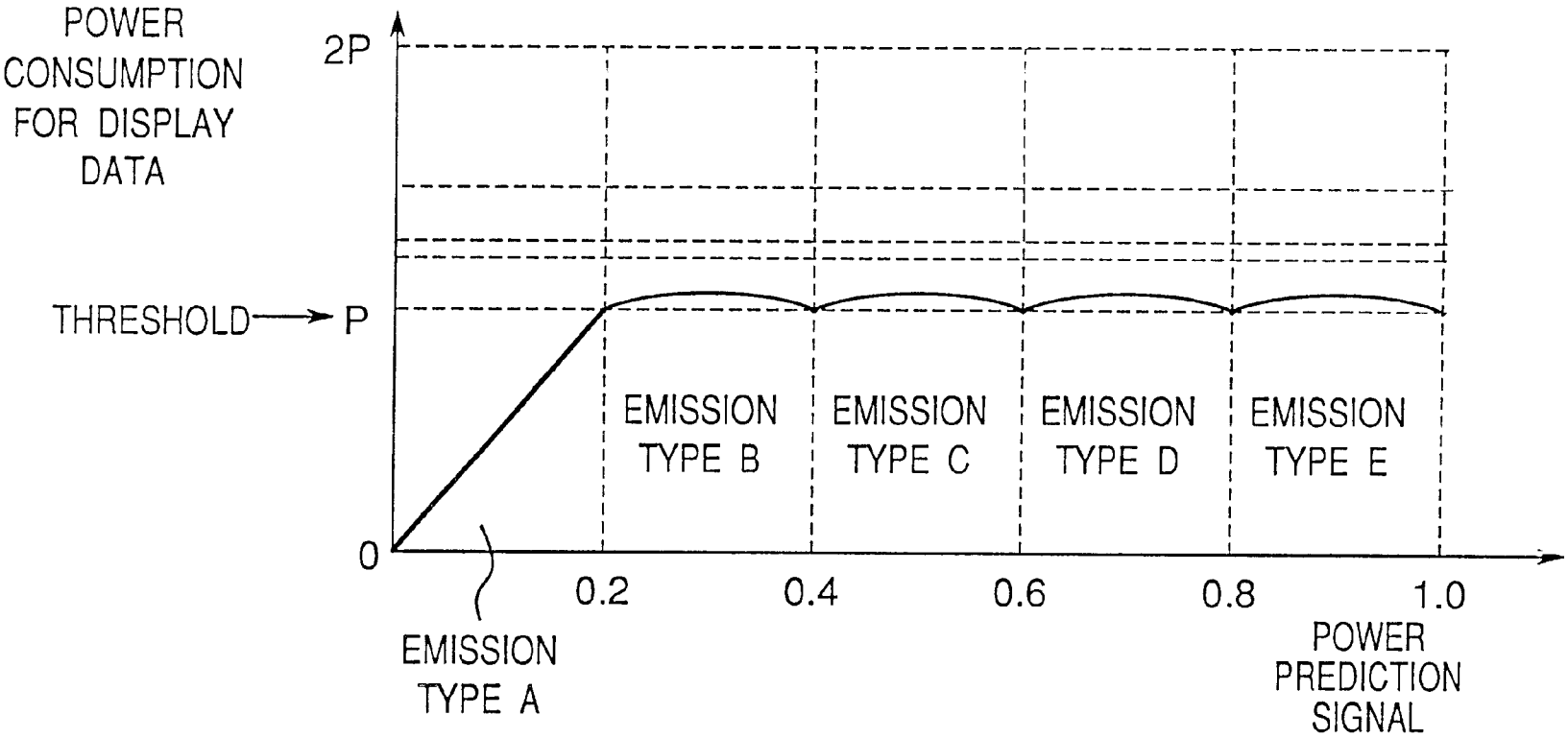
FIG. 6 is a view showing a relation between the power prediction signal and the actual consumption power when gradation correction is performed by the multiplying coefficient (first multiplying coefficient).

When the multiplying coefficient is obtained based on the power prediction signal in a manner as described above in the controller 18, the change of the consumed power to the power prediction signal has, a characteristic as shown in FIG. 6 instead of one as shown in FIG. 3. Therefore, not depending on the input picture signal, the consumed power for data display is limited not so as to be over the predetermined value P.

Figure 7:
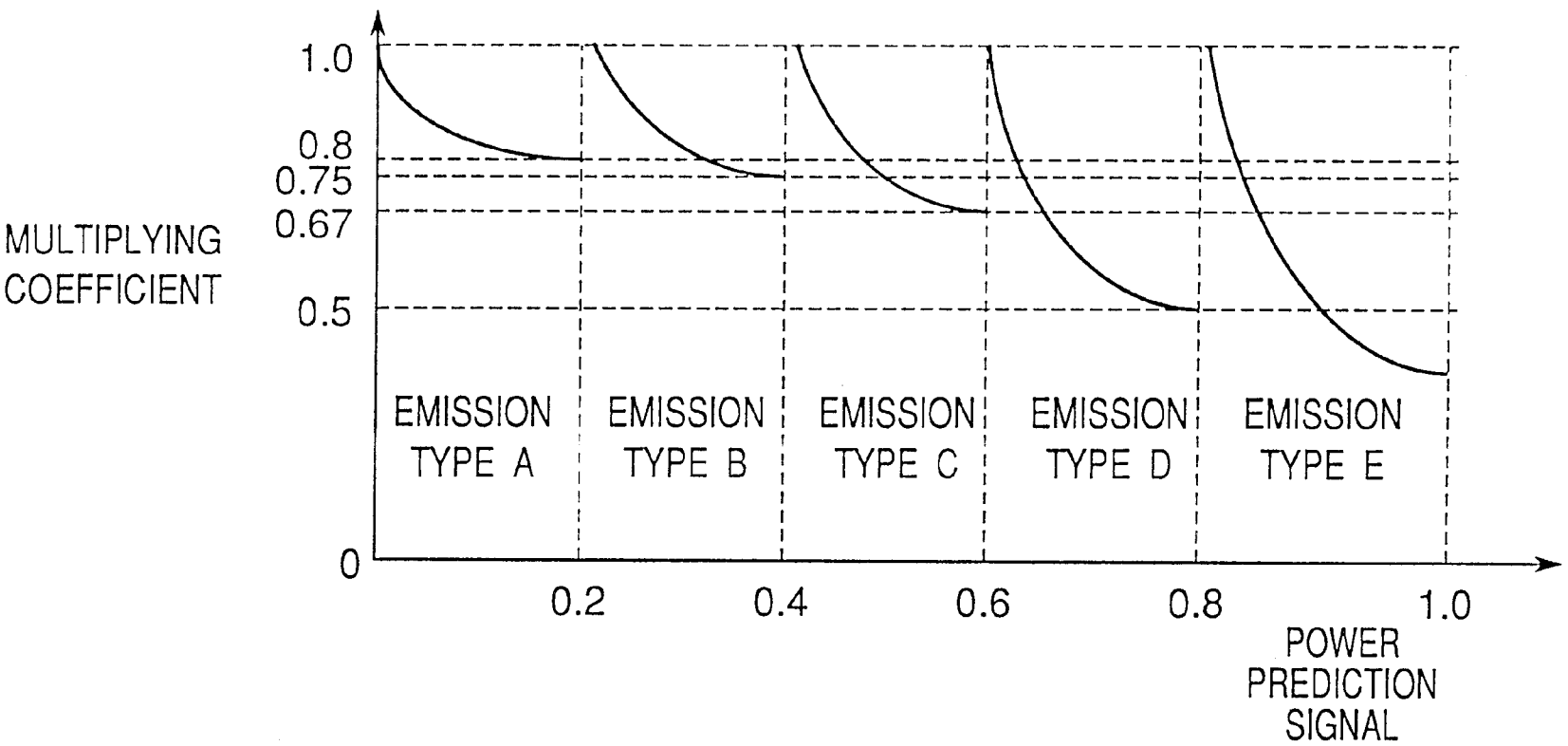
FIG. 7 is a view showing a relation between the power prediction signal and the another multiplying coefficient (second multiplying coefficient).
Figure 8:
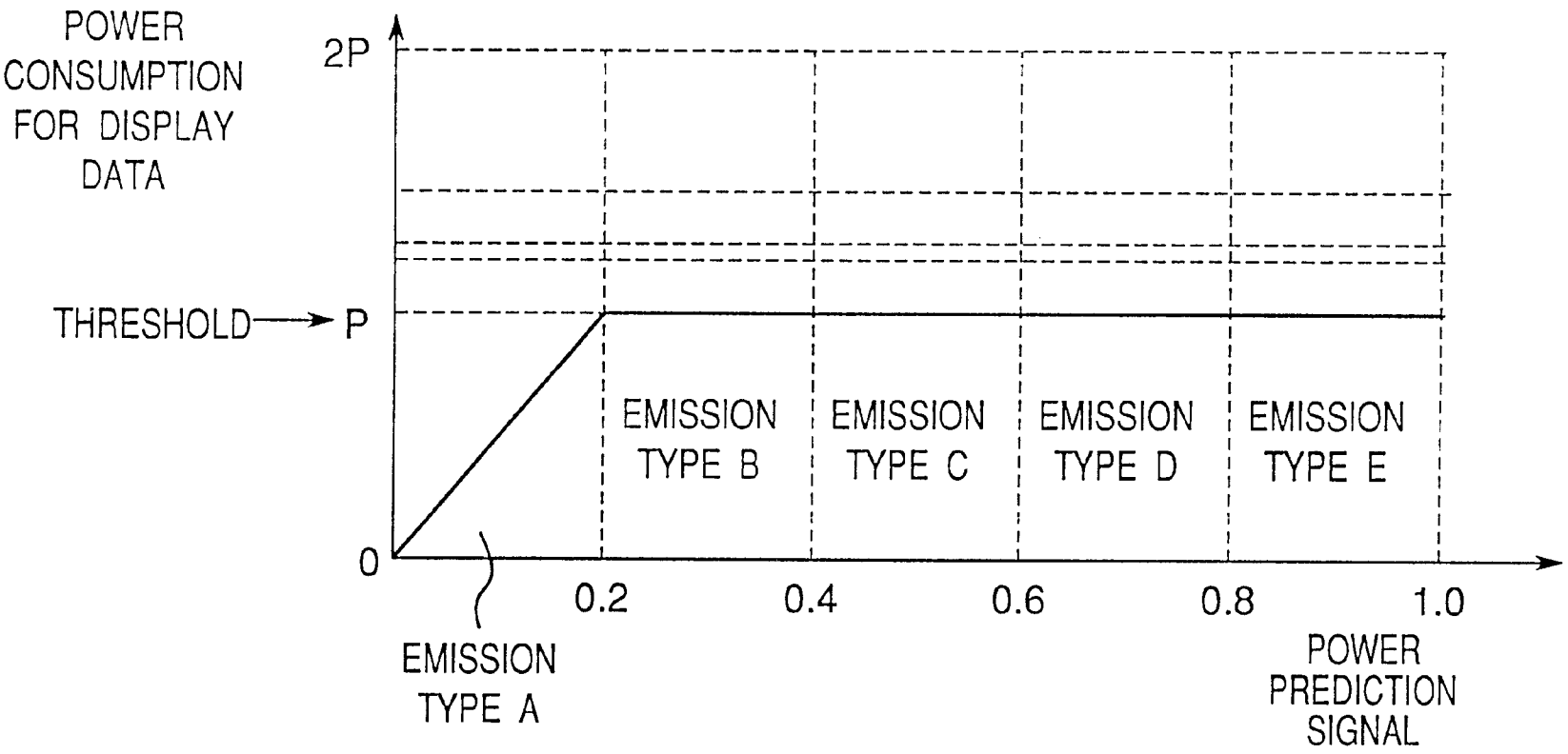
FIG. 8 is a view showing a relation between the power prediction signal and the actual consumption power when gradation correction is performed by the second multiplying coefficient.

The multiplying coefficient may be changed curvilinearly in a predetermined interval as shown in FIG. 7, while it is changed linearly as shown in FIG. 5. This can improve the characteristic of the consumed power, where the consumed power is further limited to the value P as shown in FIG. 8.

The controller 18 determines these data (emission pulse control signal and multiplying coefficient) in correspondence to the value of the power prediction signal. Specifically, the number of times of light emission and the light emission time duration are decreased, or the multiplying circuit coefficient by which the delayed picture signals is multiplied is decreased, with increasing the power prediction signal, thereby the gray scale level of a signal to be displayed in the display apparatus is decreased as compared with the gray scale level of the input picture signal. Thus, the light emission amount per unit area (luminance) in the display apparatus is adjusted so that the power to be consumed in the display apparatus is controlled.

It is also possible to adjust the light emission amount (luminance), and thereby achieve the power control, by controlling only either one of the changeover in emission type or the multiplying circuit coefficient depending on the magnitude of the power prediction signal.

As described above, in the present invention, since a power prediction signal is computed by using a coefficient representing a ratio of power consumptions necessary for data display of the individual colors, and since the power prediction signal obtained in this way is used as a parameter, the automatic power control can be achieved more accurately than in the prior art method.

Figure 9:
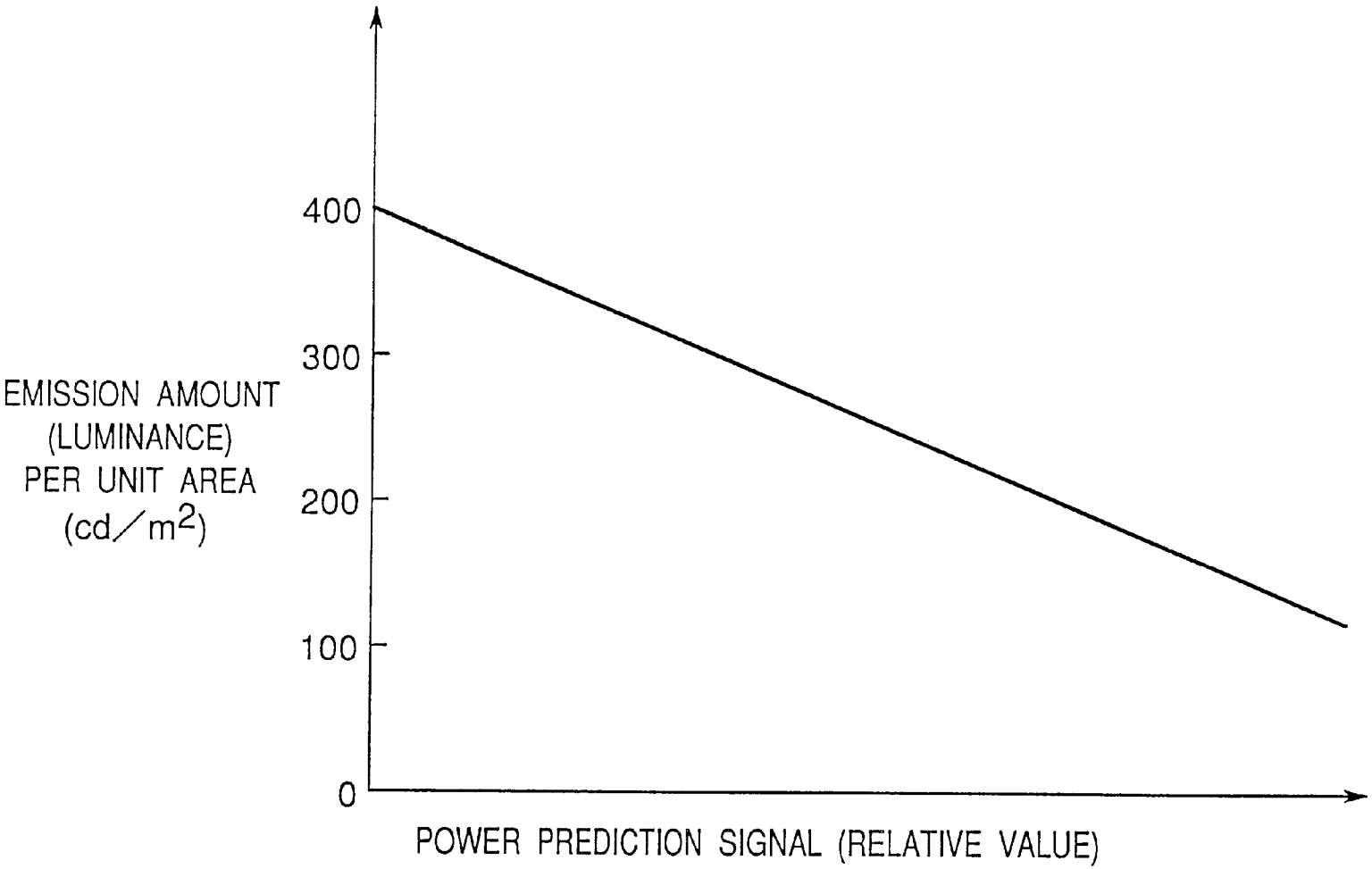
FIG. 9 is a view showing a control characteristic between the power prediction signal of the display apparatus and the light emission amount per unit area (luminance) of the display apparatus.

FIG. 9 shows a control characteristic showing variations in the power prediction signal versus the light emission amount per unit area (luminance), where the horizontal axis represents the magnitude of the power prediction signal and the vertical axis represents the light emission amount per unit area (luminance). The controller 18, by adjusting the emission type or the multiplying coefficient in response to the power prediction signal outputted from the adder 17, exerts its control function so that the power consumed in the display apparatus is inhibited from becoming excessively large, by lowering the light emission amount per unit area (luminance) as the power prediction signal increases.

(Embodiment 2)

A second embodiment of the present invention is described. This embodiment shows another determination of the parameter KR, KG and KB of Embodiment 1. In this embodiment, these parameter KR, KG and KB are determined based on a ratio of areas of individual color phosphors, while it is based on the power ratio in the Embodiment 1.

Figure 10A:
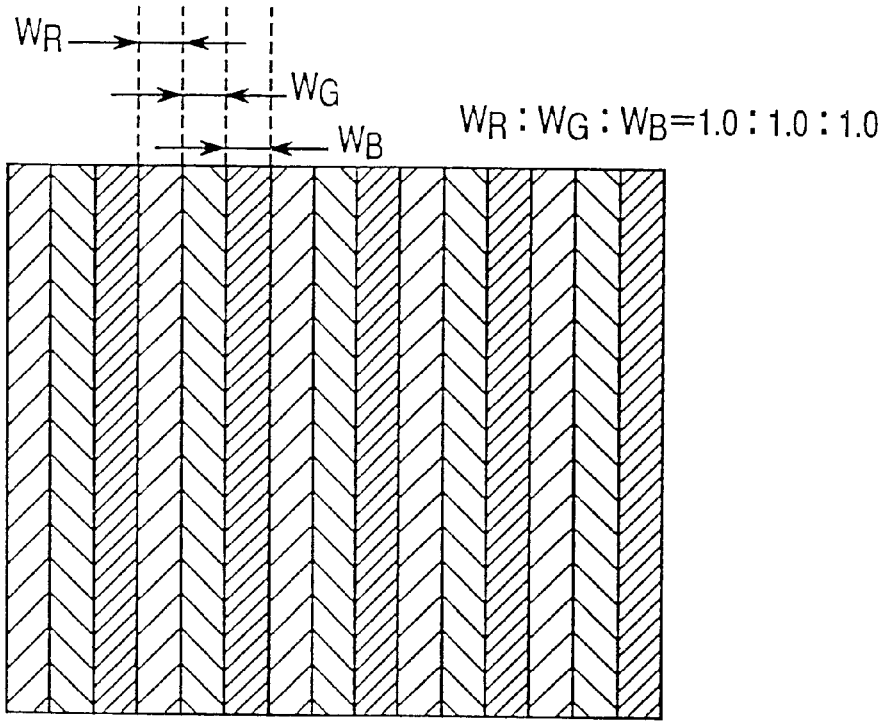
FIGS. 10A and 10B are views showing the arrangement of phosphors of a plasma display panel which is an embodiment of the present invention.

FIG. 10 shows examples of the phosphor arrangement of a plasma display panel. In FIG. 10A, the stripe structure has a ratio of widths of individual color phosphors, WR:WG:WB=1.0:1.0:1.0, so that discharge areas for R, G and B are of the same. Accordingly, a ratio of powers PR, PG and PB to be consumed for data display when the individual single colors are displayed on this panel is generally PR:PG:PB=1.0 1.0:1.0. In such a case, the ratio of he parameters KR, KG and KB with which the R average level, the G average level and the B average level is multiplied respectively are determined as KR:KG:KB=1.0:1.0:1.0. The power consumption signal can be obtained by using such parameters KR, KG and KB.

Figure 10B:
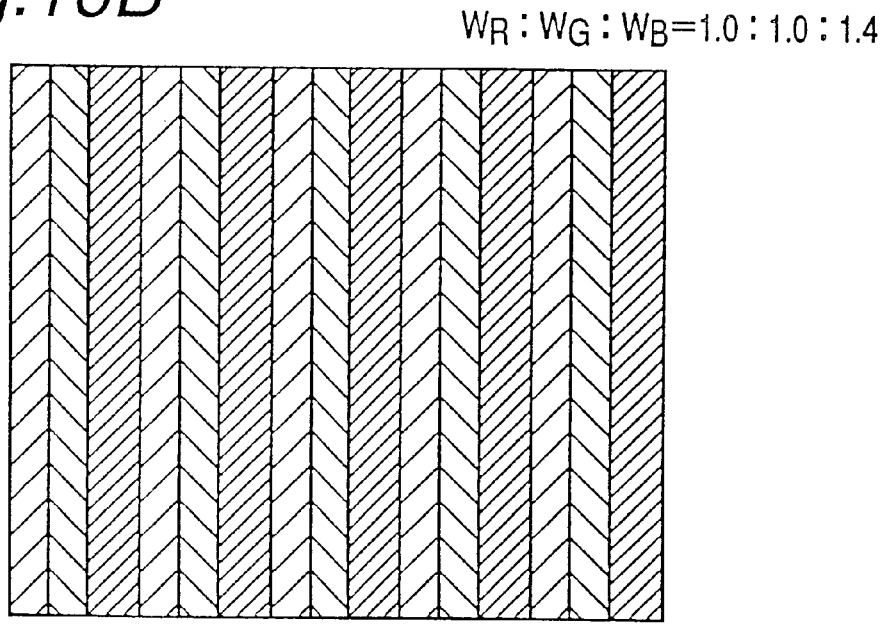
Figure 11:
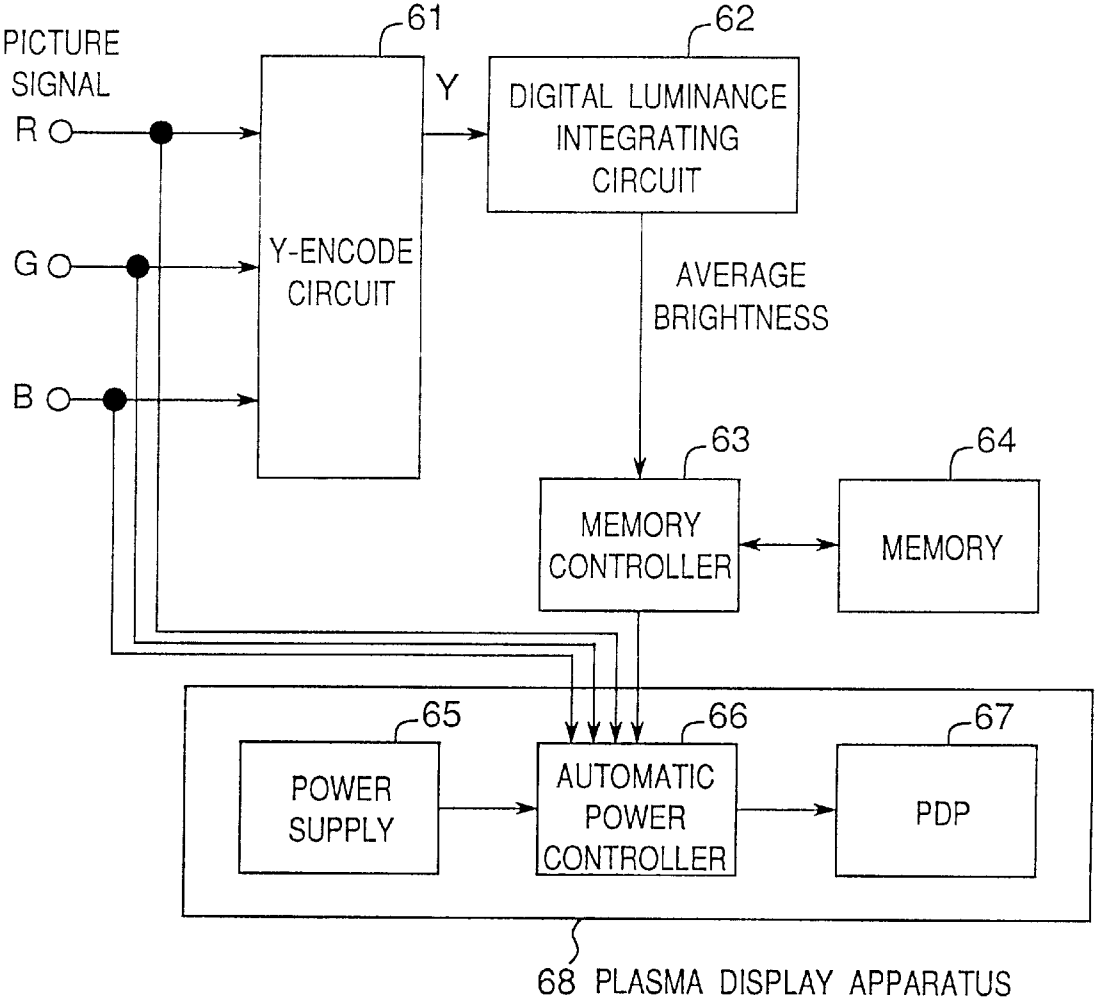
Fig.11 PRIOR ART
FIG. 11 is a block diagram showing the configuration of a display apparatus according to the prior art.

Here is discussed a case in which the widths of individual color phosphors are unbalanced with the view of improving the color temperature as shown in FIG. 10B. In FIG. 4B, WR:WG:WB=1.0:1.0:1.4, where the width WB of the blue phosphor is broadened wider than those of the other two colors so that the color temperature of the panel is heightened. In this case, differences in phosphor width results in differences in R, G and B discharge areas, and these differences are reflected in the consumed power for data display, with the result of a ratio of PR:PG:PB=1.0:1.0:1.4, generally. In such a case, if the ratio of KR, KG and KB is set as KR:KG:KB=1.0:1.0:1.4, then the power prediction signal can still be computed correctly.

Like this, the area of a phosphor is generally proportional to the power consumed for data display. Therefore, it is also possible to compute the power prediction signal in a simplified manner by inputting a ratio of phosphor areas as KR, KG and KB to the first multiplying circuit 14, the second multiplying circuit 15 and the third multiplying circuit 16 of FIG. 1, respectively.

While the display apparatus with a plasma display panel (PDP) is described above, this invention may also be applied to other emission-type display apparatus such as a LED (Light Emission Diode) display apparatus, a field emission display (FED) and so on.

According to the present invention described above, the light emission amount (luminance) in the display section of the display apparatus is controlled based on a power prediction signal which is obtained by weighting individual color average levels with coefficients representing the power consumption ratio or phosphor area ratio, and then determining a sum of those weighted color average levels. Thus, there can be provided a display apparatus which can be controlled in power consumption more accurately, as compared with the prior art method in which power consumption of the display apparatus is controlled by using average luminance.

Although the present invention has been described in connection with specified embodiments thereof, many other modifications, corrections and applications are apparent to those skilled in the art. Therefore, the present invention is not limited by the disclosure provided herein but limited only to the scope of the appended claims.

What is claimed is:

1. A display apparatus comprising:

an emission unit for emitting light to display images;

integrating circuits for integrating input picture signals of R, G and B for a predetermined period to output an average level of R signal, an average level of G signal and an average level of B signal, respectively;

first, second and third multiplying circuits for multiplying the R average level, the G average level and the B average level by their respective parameters KR, KG and KB;

a power prediction circuit for obtaining and outputting a power prediction signal indicative of amount of power expected to be consumed on the emission unit by adding output signals from the first, second and third multiplying circuits together;

a controller for receiving said power prediction signal to output a control signal based on a value of the received signal; and a brightness control circuit for controlling light emission amount of the emission unit per unit area according to the control signal.

2. The display apparatus according to claim 1, wherein a ratio of parameters KR, KG and KB is determined to be equal to a ratio of powers consumed for display each color of red, green and blue with same brightness.

3. A display apparatus comprising:

an emission unit for emitting light to display images;

integrating circuits for integrating input picture signals of R, G and B for each predetermined period to output an average level of R signal, an average level of G signal and an average level of B signal, respectively;

first, second and third multiplying circuits for multiplying the R average level, the G average level and the B average level by their respective parameters KR, KG and KB, respectively, the ratio of parameters KR, KG and KB being determined to be equal to a ratio of powers consumed for display each color of red, green and blue with same brightness;

a power consumption prediction circuit for obtaining and outputting a power prediction signal indicative of amount of power expected to be consumed on the emission unit by adding output signals from the first, second and third multiplying circuits together;

a controller for receiving said power prediction signal to output a multiplying coefficient based on a value of the received signal;

a delay circuit for delaying the input picture signals of R, G and B to output the delayed picture signals DR, DG and DB, respectively; and fourth, fifth and sixth multiplying circuits for multiplying the delayed picture signals DR, DG and DB by the multiplying coefficient, respectively.

4. A display apparatus for dividing one field of picture signal into a plurality of subfields weighted respectively, and then displaying images of subfields in superimposition on time region to realize gradation expression, said display apparatus comprising:

an emission unit for emitting light to display images;

R integrating circuit, a G integrating circuit and a B integrating circuit for integrating at least one field of input picture signals of R, G and B to output an average level of R signal, an average level of G signal and an average level of B signal, respectively;

first, second and third multiplying circuits for multiplying the R average level signal, the G average level signal and the B average level signal by parameters KR, KG and KB determined based on the ratio of powers consumed on the emission unit to display each color of red, green and blue;

a power prediction circuit for obtaining and outputting a power prediction signal indicative of amount of power expected to be consumed on the emission unit by adding output signals from the first, second and third multiplying circuits together;

a controller for receiving the power prediction signal to output a emission pulse control signal for selecting one of light emission types in response to a value of the received signal;

a delay circuit for delaying the input picture signals R, G and B to output the delayed picture signals DR, DG and DB, respectively;

a picture signal-subfield associating circuit for receiving the emission pulse control signal and the delayed picture signals DR, DG and DB, and associating output signals from the delay circuit with subfield structure of the light emission type based on the emission pulse control signal; and subfield pulse generator for receiving the emission pulse control signal, and generating pulses in the subfield structure corresponding to the light emission type based on the emission pulse control signal, the pulses including at least one of scanning pulses, sustaining pulses and erasing pulses.

5. A display apparatus for displaying images of subfields in superimposition on time region to display data with gradation, by dividing one field of picture signal into a plurality of subfields weighted, said display apparatus comprising:

an emission unit for emitting light to display images;

R integrating circuit, G integrating circuit and B integrating circuit for integrating at least one field of input picture signals of R, G and B to output an R average level signal, a G average level signal and a B average level signal, respectively;

first, second and third multiplying circuits for multiplying the R average level signal, the G average level signal and the B average level signal by respectively parameters KR, KG and KB obtained by a ratio of powers consumed for display each color of red, green or blue, a power prediction circuit for obtaining and outputting a power prediction signal indicative of power expected to be consumed on the emission unit by adding output signals from the first, second and third multiplying circuits together;

a controller for receiving said power prediction signal to output a emission pulse control signal and a multiplying coefficient according to a value of the received signal, said emission pulse control signal being available for selecting one of light emission types, said multiplying coefficient being available for equalizing gray scale level at a border of adjacent emission types, said multiplying coefficient being obtained based on said power prediction signal from the controller;

a delay circuit for delaying the input picture signals of R, G and B to output delayed picture signals DR, DG and DB, respectively;

fourth, fifth and sixth multiplying circuits for multiplying the delayed picture signals DR, DG and DB by said multiplying coefficient for collecting gray scale level so as to equalize gray scale level between adjacent emission types at changeover point of those emission types, respectively;

a picture signal-subfield associating circuit for receiving the emission pulse control signal and the signals of the fourth, fifth and sixth multiplying circuits as inputs, and associating the received signals from the fourth, fifth and sixth multiplying circuits with subfield structure of a light emission type responsive to the emission pulse control signal; and subfield pulse generator for receiving the emission pulse control signal, and generating pulses including scanning, sustaining, erasing pulses with said subfield structure of the light emission type responsive to the emission pulse control signal.

6. The display apparatus according to claim 1, wherein a ratio of the parameters KR, KG and KB is equal to a ratio of area of phosphors for each color of red, green and blue.

* * * * *